US009694487B2

(12) United States Patent
Wilson

(10) Patent No.: US 9,694,487 B2
(45) Date of Patent: Jul. 4, 2017

(54) CLAMP HORSE

(71) Applicant: William Wilson, Spooner, WI (US)

(72) Inventor: William Wilson, Spooner, WI (US)

( * ) Notice: Subject to any disclaimer, the term of this patent is extended or adjusted under 35 U.S.C. 154(b) by 53 days.

(21) Appl. No.: 14/493,103

(22) Filed: Sep. 22, 2014

(65) Prior Publication Data

US 2015/0082612 A1 Mar. 26, 2015

Related U.S. Application Data

(60) Provisional application No. 61/880,210, filed on Sep. 20, 2013.

(51) Int. Cl.

| | |
|---|---|
| ***B25B 1/02*** | (2006.01) |
| ***B25H 1/10*** | (2006.01) |
| ***B25H 1/06*** | (2006.01) |

(52) U.S. Cl.

CPC ..... *B25H 1/10* (2013.01); *B25H 1/06* (2013.01); *Y10T 29/49998* (2015.01)

(58) Field of Classification Search

CPC ..... B25B 1/103; B25B 1/2405; B25B 1/2473; B25B 5/08; B25B 5/10

See application file for complete search history.

(56) References Cited

U.S. PATENT DOCUMENTS

| | | | | |
|---|---|---|---|---|
| 3,995,716 | A | 12/1976 | Bond | |
| 4,073,484 | A * | 2/1978 | Beekenkamp | B25H 1/08 108/118 |
| 4,252,304 | A * | 2/1981 | Pettican | B25B 1/02 269/139 |
| 4,386,767 | A | 6/1983 | Dyckes | |
| 6,659,440 | B2 * | 12/2003 | Levy | B25H 1/04 269/100 |
| 2005/0194215 | A1 * | 9/2005 | Radermacher | B23D 47/025 182/181.1 |
| 2006/0124396 | A1 * | 6/2006 | DeOrnellas | B25H 1/06 182/153 |
| 2015/0082612 | A1 * | 3/2015 | Wilson | B25H 1/10 29/559 |

* cited by examiner

*Primary Examiner* — Lee D Wilson
(74) *Attorney, Agent, or Firm* — The Gray Law Group, Ltd; Robert Gray

(57) ABSTRACT

In an improved sawhorse or clamp horse, a telescoping beam is pierced by a plaurlity of apertures at an insertion angle other than orthogonal to the surface, and a plualrity of push clamps, each bent at the insertion angle, is provided. By inserting a push clamp into the telescoping beam at an insertion angle, a work piece may be held securely in temporary positions during toolwork. The clamp horse's legs terminate in T-shaped feet to provide the option of permanent installation on the floor of the workspace.

13 Claims, 3 Drawing Sheets

CLAMP HORSE

CROSS-REFERENCE TO RELATED APPLICATIONS

This application claims the benefit of U.S. Provisional Application No. 61/880,210, filed Sep. 20, 2014, which is hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to woodworking tools and accessories and in particular to an improved sawhorse. Home handymen, repairmen, remodelers, and others who work with wood and similar building materials are familiar with the problems presented by using an ordinary sawhorse. A second person is frequently needed, and the material sometimes shifts during the toolwork, resulting in spoiled materials at best, and injuries at worst. An improved sawhorse wherein a telescoping beam and cross member, with push clamps to hold work piece securely in temporary positions during toolwork, would eliminate the risk of injury and resolve these and other problems.

SUMMARY OF THE INVENTION

Accordingly, the invention is directed to an improved sawhorse or clamp horse. A telescoping beam is pierced by a plaurlity of apertures at an insertion angle other than orthogonal to the surface, and a plualrity of push clamps, each bent at the insertion angle, is provided. By inserting a push clamp into the telescoping beam at an insertion angle, a work piece may be held securely in temporary positions during toolwork. The clamp horse's legs terminate in T-shaped feet to provide the option of permanent installation on the floor of the workspace.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION OF THE INVENTION

Referring now to the invention in more detail, the invention is directed to an improved sawhorse, or clamp horse, featuring a telescoping beam 10 with push clamps 23 to hold work pieces 24 securely in temporary positions during toolwork. The clamp horse's legs terminate in T-shaped feet 22 to provide the option of permanent installation on the floor of the workspace.

Figure 9:
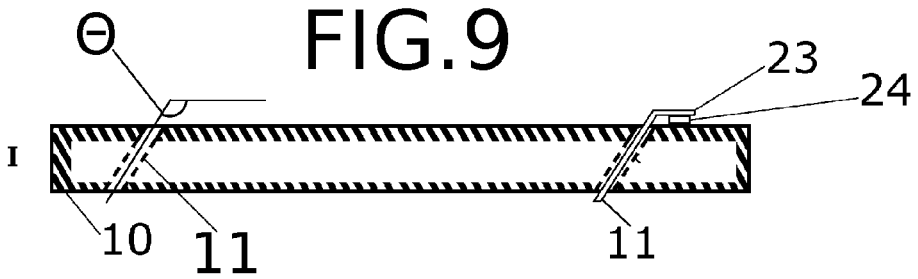
FIG. 9 shows a front sectional view along sectional plane I of FIG. 1 of a portion of the telescoping beam component of the first exemplary embodiment, displaying the insertion angle 0, the telescoping beam 10, two apertures 11, a push clamp 23, and the work piece 24; the broken lines of the apertures 11 are intended to show the intended path between the top and bottom openings of the aperture 11 within the hollow center of the telescoping beam 10.
Figure 10:
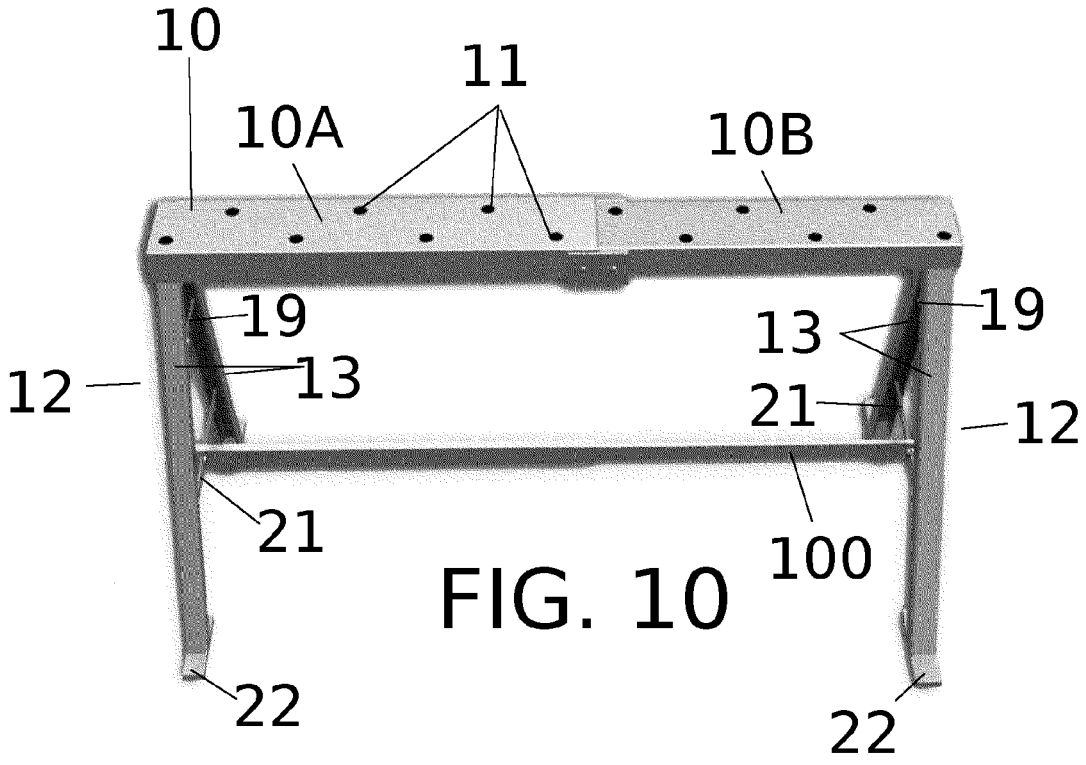
FIG. 10 shows front elevated view of the first exemplary embodiment in assembled form, displaying the telescoping beam 10, the outer telescoping section 10A, the inner telescoping section 10B, the apertures 11, the endpieces 12, the legs 13, the upper folding braces 19, the lower folding braces 21, the feet 22, and the telescoping cross member 100.
Figure 11:
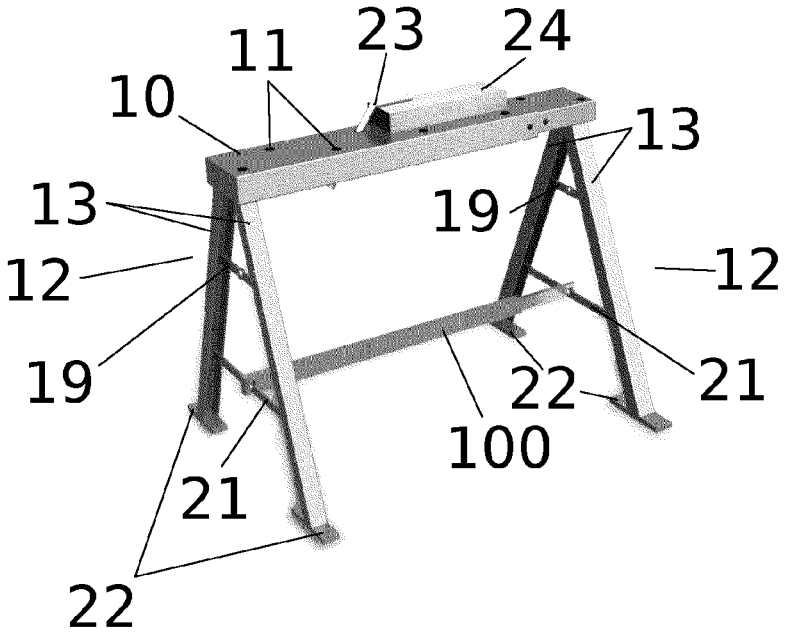
FIG. 11 shows a perspective elevated view of the first exemplary embodiment in assembled form and having a push clamp and work piece installed thereon, displaying the telescoping beam 10, the apertures 11, the endpieces 12, the legs 13, the upper folding braces 10, the lower folding braces 21, the feet 22, the push clamp 23, the work piece 24, and the telescoping cross member 100.

A telescoping beam 10 is pierced by apertures 11 into which push clamps 23 may be inserted. The apertures 11 consist of corresponding holes on the top and bottom surface of the inner telescoping section 10B or the outer telescoping section 10B, and are configured so as to correspond at an insertion angle Θ that is other than orthogonal to the surfaces of the telescoping sections 10A and 10B and that is equal to the angle of the push clamps 23. Thus, a push clamp 23 may be inserted into any aperture 11 via to top hole thereof and meet with the bottom hole thereof. The outer telescoping section 10A is necessarily hollow to accommodate the inner telescoping section 10B, and thus corresponding holes are necessary to form the aperture 11; the inner telescoping section may be hollow or of solid material, in which case the aperture 11 may be a single hole or a pair of corresponding holes at the required angle to accommodate the push clamps 23. Each push clamp 23 is itself a rigid member of circular cross section that is bent at insertion angle Θ of more than 90° such that one end of the push clamp 23 may be inserted into any of the apertures 11 forcing the other end be oriented horizontally, as shown in FIGS. 9 and 11. A sufficient number of push clamps 23 is also provided, and additional push clamps 23 are available separately.

Figure 1:
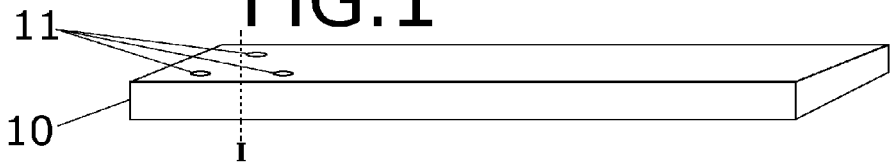
FIG. 1 shows a front perspective view of the telescoping beam component of the first exemplary embodiment, displaying the telescoping beam 10, three of the apertures 11, and sectional plane I.
Figure 2:
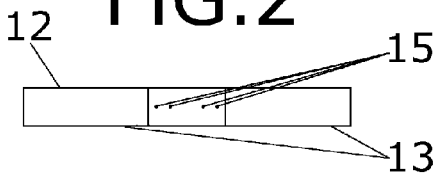
FIG. 2 shows a top view of an endpiece component of the first exemplary embodiment, displaying the endpiece 12, the legs 13, and the top mounting holes 15.
Figure 3:
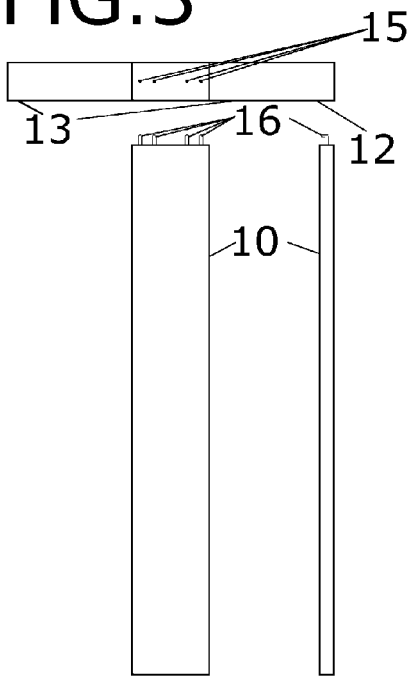
FIG. 3 shows a top view of an endpiece component, and a top and side view of the telescoping beam component of the first exemplary embodiment, displaying the telescoping beam 10, the endpiece 12, the legs 13, the top mounting holes 15, and the mounting hooks 16.
Figure 4:
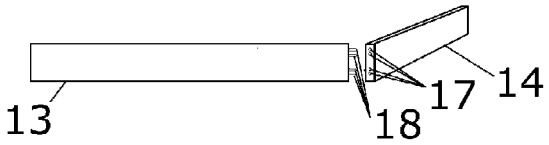
FIG. 4 shows a perspective view of a disassembled endpiece component of the first exemplary embodiment, displaying a leg 13, the cap 14, the side mounting holes 17, and the mounting pins 18.
Figure 5:
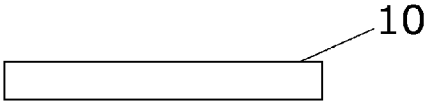
FIG. 5 shows a bottom view of the telescoping beam component of the first exemplary embodiment, displaying the telescoping beam 10.
Figure 6:
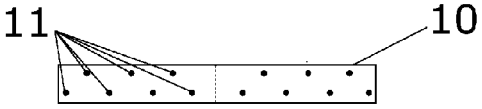
FIG. 6 shows a top view of the beam component of the first exemplary embodiment, displaying the telescoping beam 10, and the apertures 11.
Figure 7:
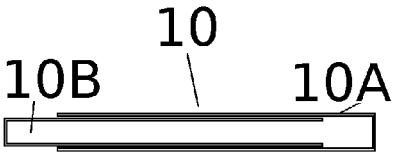
FIG. 7 shows a top cross section view of the telescoping beam component of the first exemplary embodiment in a partially telescoped position, displaying the telescoping beam 10, the outer telescoping section 10A, and the inner telescoping section 10B.
Figure 8:
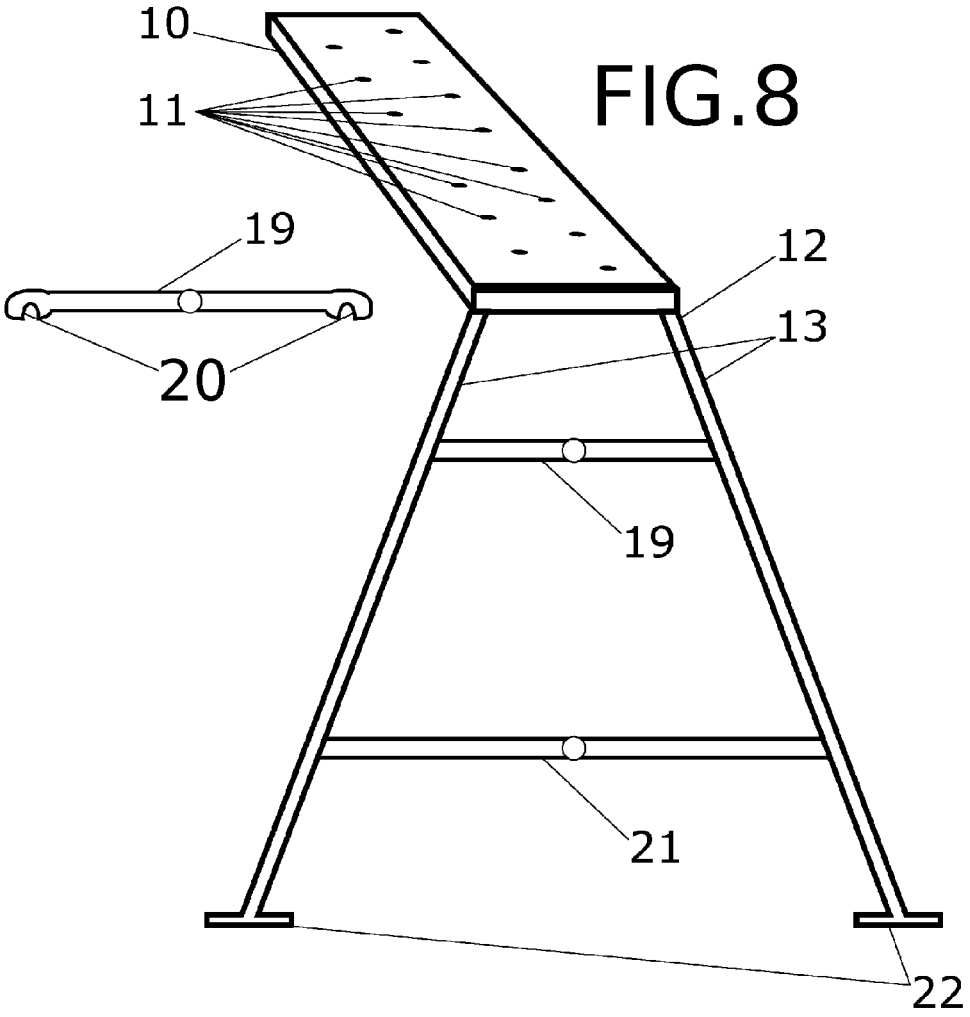
FIG. 8 shows a side perspective view of the telescoping beam component and an endpiece component of the first exemplary embodiment, with a separate side view of an upper folding brace, displaying the telescoping beam 10, the apertures 11, the endpiece 12, the legs 13, the upper folding braces 19, the slots 20, the lower folding braces 21, and the feet 22.

Two endpiece components are provided, each comprising an endpiece 12 with two legs 13, a cap 14, an upper folding brace 19, and a lower folding brace 21. Each folding brace 19 or 21 rests via a pair of slots 20 at both ends on or in compatible structures on the surface of the legs 13, shown in FIG. 8.

To use the device, the user must assemble the components. During assembly of each of the endpieces 12, each leg 13 may be affixed to a cap 14 by sliding the mounting pins 18 on the leg 13 into the side mounting holes 17 on the cap 14. Each of the four legs 13 terminates in a T-shaped foot 22. Each foot 22 is mounted pivotably on the lower end of the leg 13 with a hinge.

The telescoping beam 10 is affixed to each endpiece 12 by inserting the mounting hooks 16 on the end of the beam 10 into the top mounting holes 15 on the cap 14 of the endpiece 12, such the pair of endpieces 12 form primary support for the telescoping beam 10. The telescoping beam 10 is then telescoped to its desired length by sliding the inner telescoping section 1013 longitudinally within the outer telescoping section 10A, and may then be locked at that length using any of many available tension or locking mechanisms known in the prior art.

Each upper folding brace 19 and lower folding brace 21 may be affixed to the legs 13 by sliding flanged pegs on the interior surfaces of the legs 13 into slots 20 provided at the ends of each upper folding brace 19 and lower folding brace 21. The telescoping cross member 100, when telescoped to the desired length, may be locked at that length to prevent collapse and may be affixed to the lower folding braces 21, by sliding the lower folding braces 21 into slots provided at the end of the cross member. Each foot 22 preferably is pierced by a plurality of holes, to facilitate permanent installation of the device on the floor of the workspace, using bolts, nails or screws.

The user may then place the work piece 24 on the telescoping beam 10 push the work piece 24 into one of the push clamps 23, which is inserted into the apertures 11 as desired such that the work piece 24 is frictionally engaged and securely retained between the telescoping beam 10 and the push clamp 23. The user may then proceed with applying toolwork. When toolwork is completed on the work piece 24, the push clamps 23 are removed from the apertures 11 and the work piece 24 is removed from the beam 10.

The beam 10 and cross member are preferably manufactured from rigid, durable, tubular metal with a high tensile strength and a rectangular cross section, such as tubular steel. The legs 13 and caps 14 are preferably manufactured from rigid, durable materials such as steel, aluminum, wood, or fiberglass. The mounting hooks 16, the mounting pins 18, the upper folding braces 19, the lower folding braces 21, the flanged pegs, the feet 22, and the push clamps 23 are preferably manufactured from rigid, durable metal with a high tensile strength, such as steel or aluminum.

Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A clamp horse comprising:

(a) a telescoping beam;

(b) said telescoping beam comprising an inner telescoping section and an outer telescoping section slidably joined such that said inner telescoping section slides longitudinally within said outer telescoping section;

(c) said telescoping beam being capable of being locked at a desired length;

(d) said telescoping beam being pierced by a plurality of apertures an insertion angle;

(e) a plurality of push clamps;

(f) each of said plurality of push clamps and each of said plurality of apertures being compatibly shaped;

(f) each of said plurality of push clamps being bent at said insertion angle;

(g) a pair of endpieces;

(h) said telescoping beam being removably affixed to said pair of endpieces such that said pair of endpieces support said telescoping beam.

2. The clamp horse of claim 1 wherein:

(a) each of said pair of endpieces comprises a pair of legs;

(b) each of said pair of legs terminating at its lower end in a T-shaped foot mounted pivotably thereon;

(c) said pair of legs being joined cross-wise by at least one folding brace;

(f) said pair of endpieces being joined crosswise by a telescoping cross member;

(g) said telescoping cross member being affixed between said pair of endpieces at one of said at least one folding brace.

3. The clamp horse of claim 2 wherein said feet are capable of being affixed to the floor on which said feet sit.

4. The clamp horse of claim 1 further comprising a work piece; said work piece being frictionally engaged and securely retained between said telescoping beam and one of said plurality of push clamps, wherein said one of said plurality of push clamps is inserted into one of said plurality of apertures; whereby said work piece is retained securely during toolwork thereon.

5. The clamp horse of claim 2 further comprising a work piece; said work piece being frictionally engaged and securely retained between said telescoping beam and one of said plurality of push clamps, wherein said one of said plurality of push clamps is inserted into one of said plurality of apertures; whereby said work piece is retained securely during toolwork thereon.

6. The clamp horse of claim 3 further comprising a work piece; said work piece being frictionally engaged and securely retained between said telescoping beam and one of said plurality of push clamps, wherein said one of said plurality of push clamps is inserted into one of said plurality of apertures; whereby said work piece is retained securely during toolwork thereon.

7. A method of using the clamp horse of claim 1 comprising extending and locking said telescoping beam to a desired length, affixing said telescoping beam to said pair of endpieces; placing a workpiece on said telescoping beam; inserting one of said plurality of push clamps into one of said plurality of apertures; pushing said workpiece between said one of said plurality of push clamps and said telescoping beam such that said work piece is frictionally engaged and securely retained between said telescoping beam and said one of said plurality of push clamps; and applying toolwork to said work piece.

8. A method of using the clamp horse of claim 2 comprising extending and locking said telescoping beam to a desired length, affixing said telescoping beam to said pair of endpieces; placing a workpiece on said telescoping beam; inserting one of said plurality of push clamps into one of said plurality of apertures; pushing said workpiece between said one of said plurality of push clamps and said telescoping beam such that said work piece is frictionally engaged and securely retained between said telescoping beam and said one of said plurality of push clamps; and applying toolwork to said work piece.

9. A method of using the clamp horse of claim 3 comprising extending and locking said telescoping beam to a desired length, affixing said telescoping beam to said pair of endpieces; placing a workpiece on said telescoping beam; inserting one of said plurality of push clamps into one of said plurality of apertures; pushing said workpiece between said one of said plurality of push clamps and said telescoping beam such that said work piece is frictionally engaged and securely retained between said telescoping beam and said one of said plurality of push clamps; and applying toolwork to said work piece.

10. The method of claim 8 further comprising, incident to affixing said telescoping beam to said pair of endpieces: unfolding each of said at least one folding brace; extending and locking said telescoping cross member to said desired length; and affixing said telescoping cross member being between said pair of endpieces at one of said at least one folding brace.

11. The method of claim 9 further comprising, incident to affixing said telescoping beam to said pair of endpieces: unfolding each of said at least one folding brace; extending and locking said telescoping cross member to said desired length; and affixing said telescoping cross member being between said pair of endpieces at one of said at least one folding brace.

12. The method of claim 9 further comprising, incident to affixing said telescoping beam to said pair of endpieces: affixing said feet to the floor on which said feet sit.

13. The method of claim 11 further comprising, incident to affixing said telescoping beam to said pair of endpieces: affixing said feet to the floor on which said feet sit.

* * * * *